US005242237A

United States Patent [19]

Wagner

[11] Patent Number: 5,242,237

[45] Date of Patent: Sep. 7, 1993

[54] BINDER WITH INTEGRAL BOOK BAND

[75] Inventor: Paul R. Wagner, Radford, Va.

[73] Assignee: P. A. Plymouth Inc., Radford, Va.

[21] Appl. No.: 914,617

[22] Filed: Jul. 20, 1992

[51] Int. Cl.[5] ..... B42F 73/40

[52] U.S. Cl. ..... 402/80 R; 281/29; 24/200; 248/499; 402/73

[58] Field of Search ..... 402/80 R, 20, 73; 281/29, 45; 248/499; 24/200

[56] References Cited

U.S. PATENT DOCUMENTS 2,709,289 5/1955 Maysilles ..... 24/200

3,142,495 7/1964 Lu ..... 281/29

*Primary Examiner*—Paul A. Bell

*Attorney, Agent, or Firm*—Wegner, Cantor, Mueller & Player

[57] ABSTRACT

A notebook binder with an integral book band for holding sheets of paper, loose books or other objects affixed to the interior and exterior faces of a cover of the notebook binder. The objects are held against the cover of the notebook binder by the use of an adjustable strap which encircles the objects with two loops that are substantially perpendicular to one another. The strap passes through a strap slot in a cover of the binder. The apparatus has the multiple, simultaneous, advantages of consolidating a group of papers, books or other objects onto the face of a binder cover with a single strap, maintaining the strap attached to the binder in a prealigned, readily usable, perpendicular loop configuration and discouraging unintended uses of the strap.

18 Claims, 6 Drawing Sheets

BINDER WITH INTEGRAL BOOK BAND

FIELD OF THE INVENTION

The binder with integral book band is directed to a notebook binder having a cover which includes a strap for securing a plurality of objects to the face of the notebook binder cover. The cover of the binder has at least one binder strap slot through which the strap is passed. This secures the strap to the binder. A binder equipped with a strap according to the invention can have objects secured to both the outside face and the inside face of a binder cover by means of a single strap. The invention has the multiple, simultaneous, advantages of consolidating a group of papers, books or other objects onto the face of a binder cover with a single elastic strap, maintaining the strap attached to the binder in a readily usable perpendicular loop configuration, helping to prevent an individual from mislaying the book strap and discouraging unintended uses of the strap.

BACKGROUND OF THE INVENTION

Woven cloth book band straps have been used in the prior art to secure a plurality of books into a compact and easy to carry bundle. Woven cloth book bands are usually configured into two approximately perpendicular loops which encircle the books to be bundled. These book band straps have been fashioned from both nonelastic and elastic woven cloth. The prior art nonelastic bookbands utilize a buckle to tighten a single nonelastic strap around the books to be bundled. The prior art elastic bookbands use either a single elastic strap or two separate straps which are preconfigured into two continuous loops which are joined together at a single common point.

Notebook binders have been used to organize, hold and carry loose pieces of paper. The prior art notebook binders have been provided with covers having interior pockets or spring loaded clips to secure papers or other objects onto the inside face of the notebook binder cover.

The prior art book bands, and methods for using them to secure objects into a bundle have numerous disadvantages. One disadvantage of nonelastic book- band straps is that they must be properly tightened for the bundle to be properly secured. This requires forming the strap into a perpendicular loop configuration and the application of physical force to tighten the strap. Consequently, the buckle of a nonelastic book band is subject to breakage, especially if the buckle is made of plastic and the ambient temperature is low. Another disadvantage of nonelastic book band straps is that they can be difficult for young children or handicapped individuals to align for use in the necessary perpendicular loop configuration.

Elastic book band straps can also be difficult for some individuals to align for use. Elastic book bands that are in a preconfigured state have been known in the prior art. These preconfigured elastic book bands are formed of two separate continuous loop straps joined together at a single common point. Preconfigured elastic book bands are easier to align for use. However, the individual loops of the prior art preconfigured elastic book bands have a limited capacity and are susceptible to breakage because one of the loops can not gather additional material from the other loop even if it is subject to much higher stress than the other loop. Thus, the prior art preconfigured elastic book bands have the disadvantage that they are subject to unequal stress because they are not self compensating. Also, an unattached elastic book band strap, e.g. a bungee cord, can be easily misused by a childish possessor as a weapon to strike another or launch a projectile.

SUMMARY OF THE INVENTION

The invention is directed to an article for affixing objects onto the face of a notebook binder cover. The invention includes a strap, a buckle having at least two strap slots and a binder having at least one binder strap slot. The strap passes through the at least one binder strap slot at least once and through the at least two strap slots of the buckle at least once. The invention is particularly suited to affixing a pile of books or papers to an inside and/or outside face of a hinged ring notebook binder. The strap of the invention is held in the preconfigured form of two perpendicular loops even when the loops of the strap are encircling only the cover of the binder, maintaining the strap attached to the binder in a readily usable perpendicular loop configuration. Since the buckle and strap are attached to the face of the binder by passing the strap through the binder strap slot, the invention also has the effect of discouraging unintended uses of the strap.

BRIEF DESCRIPTION OF THE DRAWINGS

These and other aspects of the invention are apparent from the following drawings, in which.

DETAILED DESCRIPTION OF THE INVENTION

Figure 1:
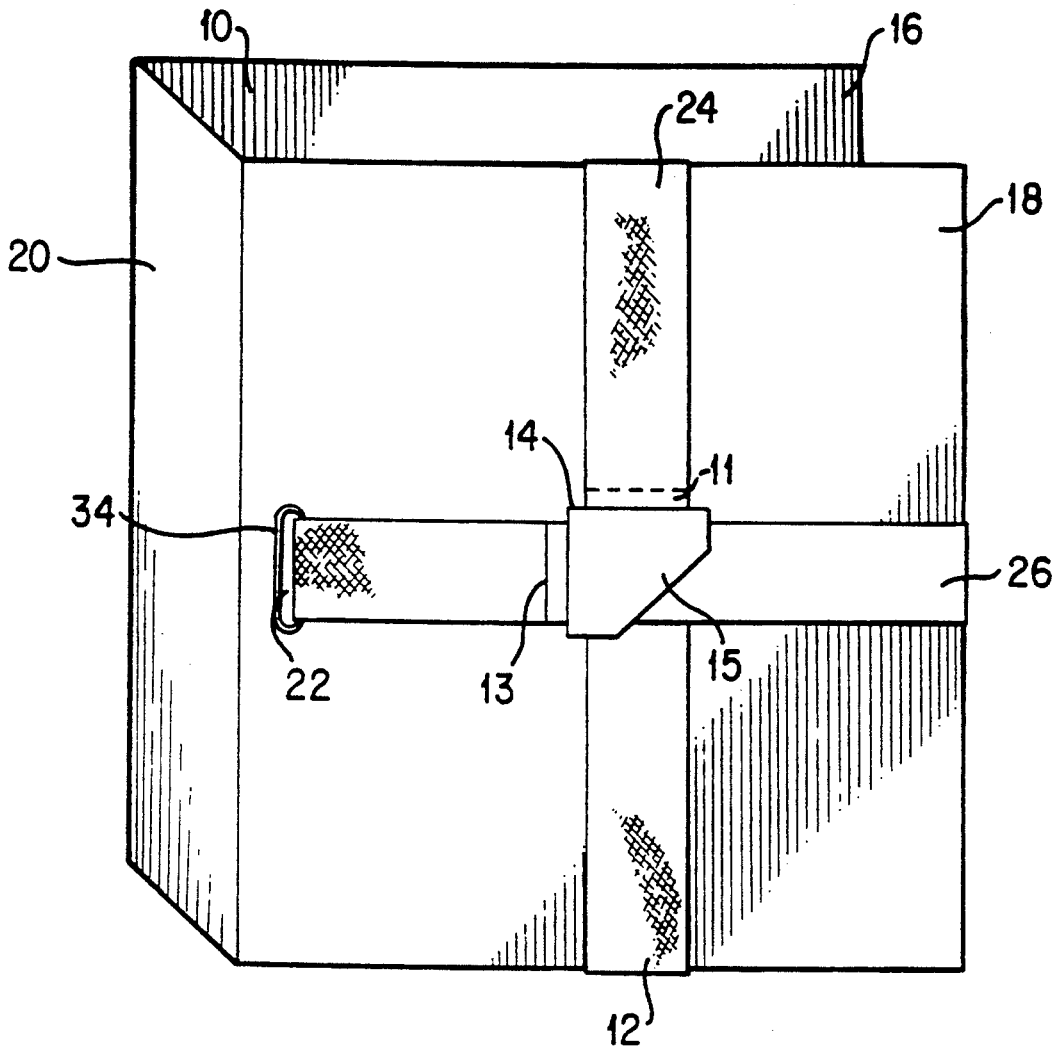
FIG. 1 shows a perspective view of a hinged ring notebook binder according to the invention in a closed position.

Referring to the drawings, FIG. 1 shows a binder according to the present invention. The binder includes notebook binder 10 The binder 10 is attached to a single elastic woven cloth strap 12 having a first end 11 and a second end 13. The first end 11 and second end 13 are sewn onto the strap 12 to form terminal loops. The ends can also be secured by other means, such as the use of rivets. Buckle 14 is attached to the elastic strap 12. The notebook binder includes a first cover 16, a second cover 18 and center spine 20. The second cover 18 has at least one binder strap slot 22. The single elastic woven cloth strap 12 passes through the at least one binder strap slot 22 once. Located around the edge of binder strap slot 22 is a metal grommet 34. The buckle 14 of this embodiment has a buckle cover 15. The notebook binder 10 and the buckle 14 hold the elastic strap 12 in a configuration that defines two approximately perpendicular loops 24 and 26, even while the loops 24 and 26 encircle only the second cover 18. Approximately, within this context, means plus or minus twenty degrees. This feature has the important benefit of maintaining the elastic strap in a readily usable preconfigured state. Moreover, the two loops 24 and 26 are self equalizing with respect to the amount of tension they are under because the loops 24 and 26 are formed from a single elastic strap 12. This is in contrast to the prior art preconfigured elastic book bands whose loops are subject to uneven stress because they are not self equalizing.

Figure 2:
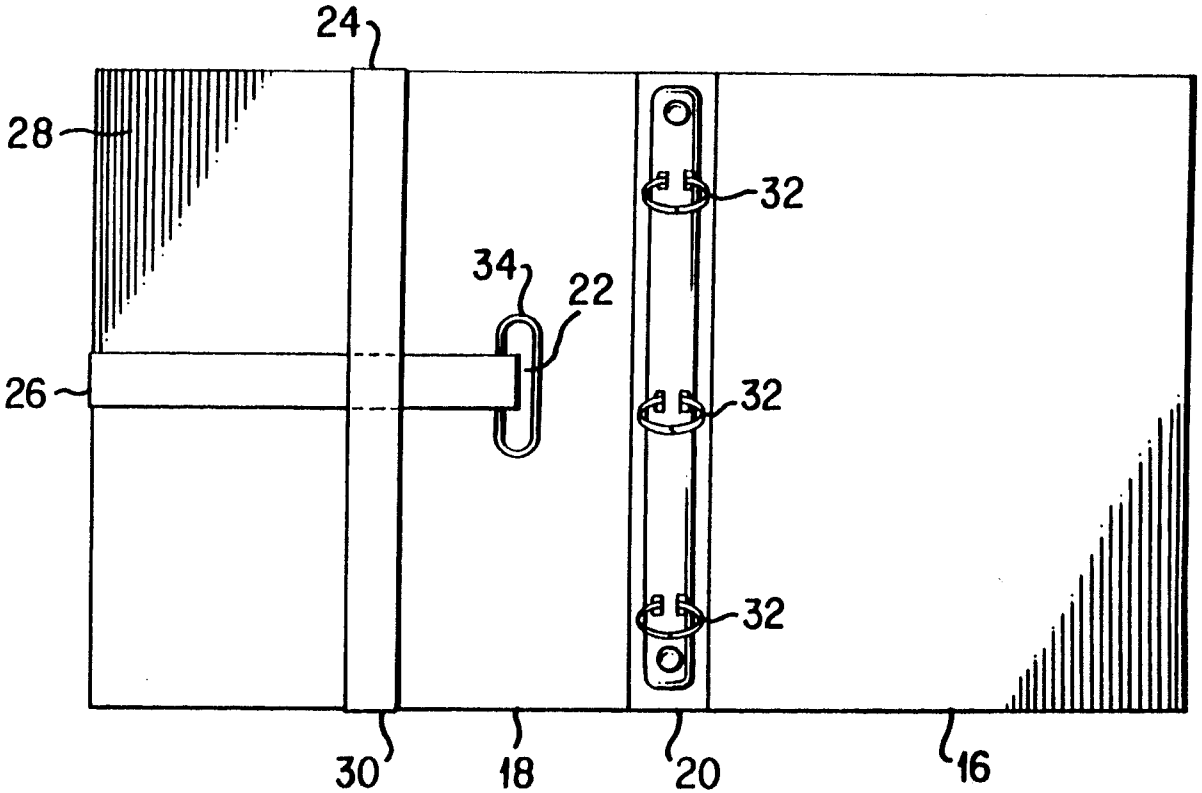
FIG. 2 shows a plan view of a hinged ring notebook binder according to the invention in an open position.

FIG. 2 shows another view of the binder according to the present invention. The hinged ring notebook binder 28 is attached to the single woven cloth strap 30. The single strap 30 has a first end and a second end. The hinged ring notebook binder 28 includes a first cover 16, a second cover 18, center spine 20 and rings 32. The buckle attached to the strap 30 is not visible in this drawing, but is shown in FIG. 1. The second cover 18 has a binder strap slot 22. The strap 30 passes through the binder strap slot 22 once. Located around the edge of binder strap slot 22 is a metal grommet 34. The notebook binder 28 and the buckle hold strap 30 in a configuration that defines two approximately perpendicular loops 24 and 26 even while the loops encircle only said second cover 18.

Figure 3:
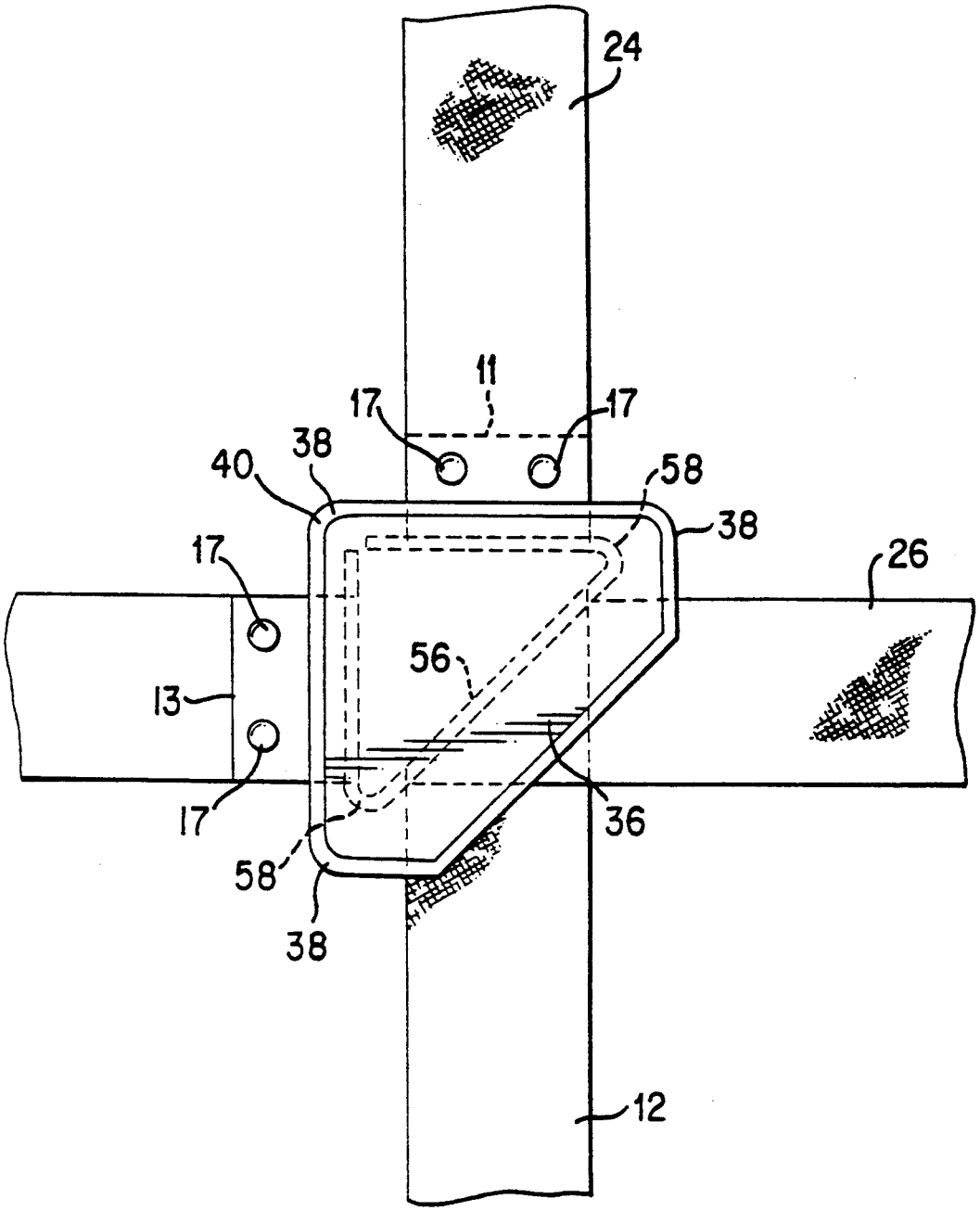
FIG. 3 shows a plan view of a buckle connected to a strap with a bent metal wire according to the invention.

FIG. 3 shows an embodiment of a buckle 36 connected to a single elastic woven cloth strap 12 according to the invention. The buckle 36 has rounded corners 38 and buckle cover 40. The buckle 36 has an internal buckle plate which is not visible in this figure, but which has the general configuration shown in FIG. 4. The buckle can be made of any suitable material, such as a polymeric material or metal. The buckle cover 40 is attached to the internal buckle plate for example by the use of welding or by the use of glue. The single elastic woven cloth strap 12 is arranged so as to pass through the binder cover, by means of the binder cover strap slot 22, and define two loops 24 and 26 that are in a approximately perpendicular configuration. Bent metal wire rod 56 has two acute bends 58. The elastic woven cloth strap 12 is connected to a first of the two buckle strap slots that are positioned so as to be perpendicular to one another by riveting the first end 11 of the elastic strap to the elastic strap 12, with rivets 17 to form a first terminal loop, passing the first terminal loop through the first of the two buckle strap slots and connecting the first terminal loop to the first of the two buckle strap slots by passing bent metal rod 56, which is longer than the first of the two buckle strap slots, through the first terminal loop. The terminal loop can also be formed by sewing instead of, or in addition to, riveting. Then the elastic strap 12 is connected to the buckle strap slot that is positioned so as to be at an acute angle relative to the two of the buckle strap slots that are positioned so as to be substantially perpendicular to one another by doubling the elastic strap 12 upon itself to form a pinched loop, passing the pinched loop through the buckle strap slot that is positioned so as to be at an acute angle relative to the two of the buckle strap slots that are positioned so as to be substantially perpendicular to one another and connecting the pinched loop to the buckle strap slot that is positioned so as to be at an acute angle relative to the two of the buckle strap slots that are position so as to be substantially perpendicular to one another by passing the metal rod 56, which is longer than buckle strap slot that is positioned so as to be at an acute angle relative to the two of the buckle strap slots that are position so as to be substantially perpendicular to one another, through the pinched loop. Substantially, within this context, means plus or minus ten degrees. The elastic strap is connected to the second of the two buckle strap slots that are positioned so as to be perpendicular to one another by riveting the second end 13 of the elastic strap to the elastic strap 12 to form a second terminal loop, passing the second terminal loop through the second of the two buckle strap slots that are positioned so as to be substantially perpendicular to one another and connecting the second terminal loop to the second of the two buckle strap slots by passing said bent metal rod 56, which is longer than the second of the two buckle strap slots, through the second terminal loop. The bent metal rod 56 can be made of other material, e.g. plastic.

Figure 4:
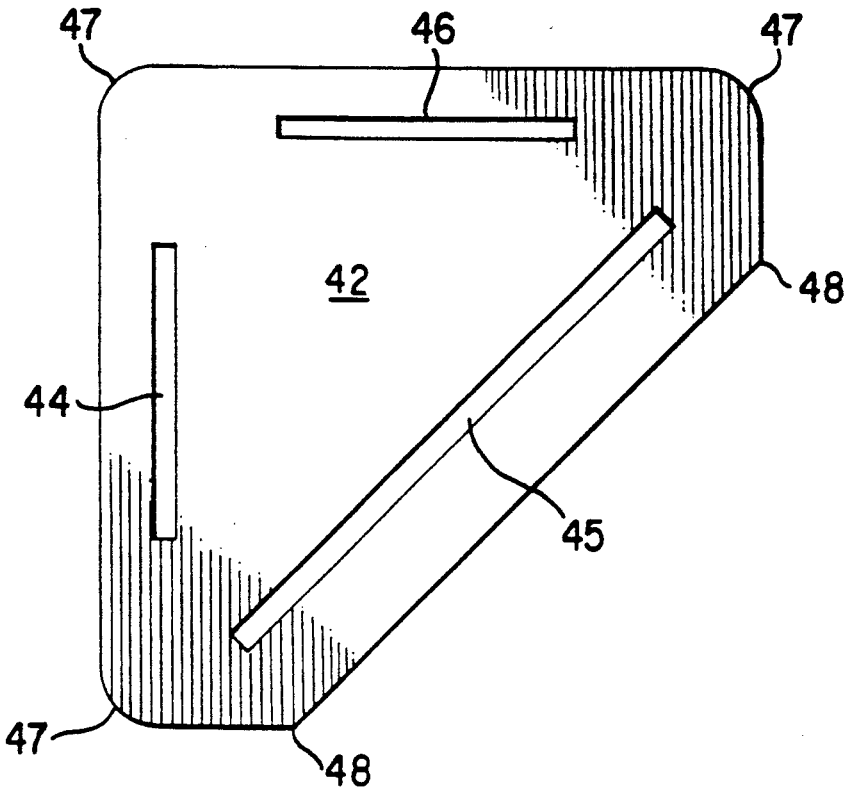
FIG. 4 shows a plan view of an embodiment of a buckle plate according to the invention.

FIG. 4 shows a planar buckle plate 42. The planar buckle plate can also be fabricated from a polymeric stock material, which is a suitable material or from other suitable materials. The planar buckle plate 42 has three buckle strap slots 44, 45 and 46. Two of the buckle strap slots 44 and 46 are positioned so as to be substantially perpendicular to one another. One of the buckle strap slots 45 is positioned so as to be at an acute angle relative to the two buckle straps slots 44 and 46 that are positioned so as to be substantially perpendicular to one another. The planar metallic buckle plate 42 has rounded corners 47. The planar metallic buckle plate 42 has angular corners 48. An elastic strap, which is not shown in this figure, passes through the each of the three buckle strap slots 44, 45 and 46 at least once. The elastic strap is connected to a first of the two buckle strap slots that are positioned so as to be perpendicular to one another 44 by riveting the first end of the elastic strap to the elastic strap to form a first terminal loop, passing the first terminal loop through the first of the two buckle strap slots and connecting the first terminal loop to the first of the two buckle strap slots by passing a bent metal rod, which is longer than the first of the two buckle strap slots 44, through the first terminal loop. The terminal loop can also be formed by sewing instead of, or in addition to, riveting. Then the elastic strap is connected to the buckle strap slot 45 that is positioned so as to be at an acute angle relative to the two of the buckle strap slots 44 and 46 that are positioned so as to be substantially perpendicular to one another by doubling the elastic strap upon itself to form a pinched loop, passing the pinched loop through the one of the buckle strap slots 45 and connecting the pinched loop to the one of the buckle strap slots by passing the metal rod, which is longer than buckle strap slot 45, through the pinched loop. By passing the strap through buckle strap slot 45, the strap is configured to define a first loop. The second end of the strap is then connected to buckle strap slot 46 to define a second loop. By defining the first and second loops, the strap can be arranged to encircle the notebook binder, which is not shown in this figure, and complete the approximately perpendicular configuration. The elastic strap is connected to the second of the two buckle strap slots 46 that are positioned so as to be perpendicular to one another by riveting the second end of the elastic strap to the elastic strap to form a second terminal loop, passing the second terminal loop through the second of the two buckle strap slots 46 and connecting the second terminal loop to the second of the two buckle strap slots by passing the bent metal rod, which is longer than the second of the two buckle strap slots 46, through the second terminal loop. The bent metal rod can also be made of other suitable materials. The planar buckle plate can also be used without a bent metal rod by forming a first terminal loop after one of the strap ends are passed through one of the perpendicular slots, passing the second strap end through the angled slot and then forming a second terminal loop after the second strap end is passed through the other perpendicular slot.

Figure 5:
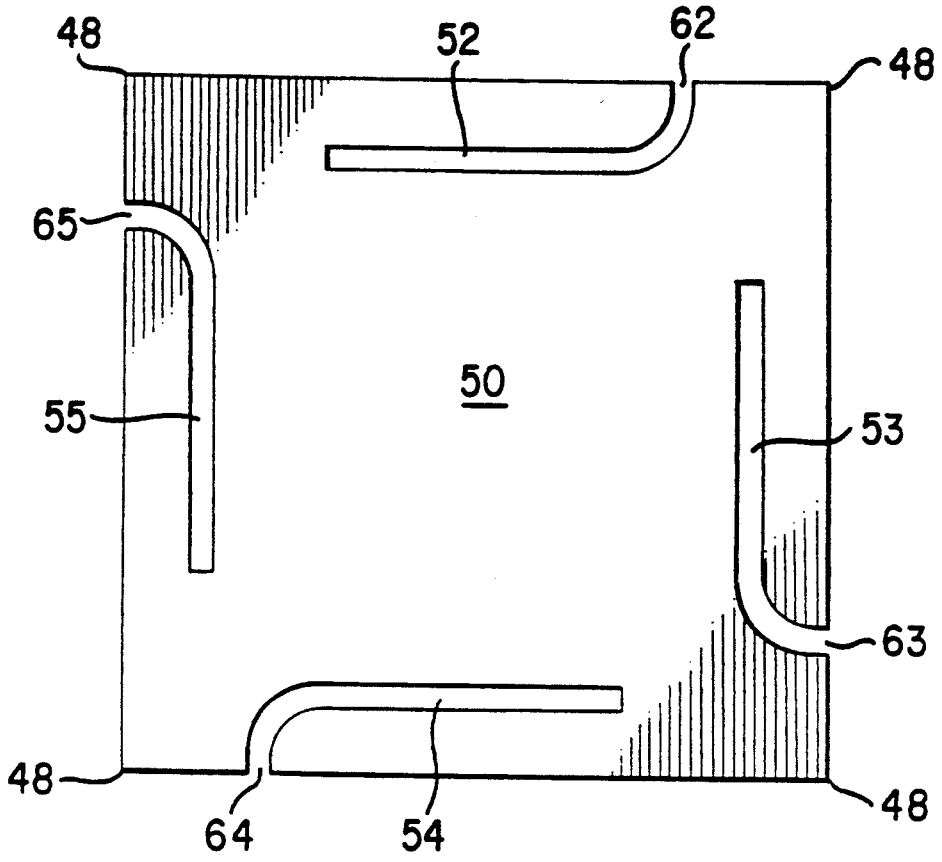
FIG. 5 shows a plan view of another embodiment of a buckle plate according to the invention.

FIG. 5 shows a planar buckle plate 50 according to the invention. The planar buckle plate 50 has four buckle strap slots 52, 53, 54 and 55. The buckle strap slots 52 and 54 are positioned so as to be substantially parallel to one another. The buckle strap slots 53 and 55 are positioned so as to be substantially parallel to one another. The buckle strap slots 52 and 53 are positioned so as to be substantially perpendicular to one another. The buckle strap slots 54 and 55 are positioned so as to be substantially perpendicular to one another. The planar metallic buckle plate 50 has angular corners 48. The buckle strap slots 52, 53, 54 and 55 are open to and accessible from an edge of the buckle through a buckle strap slot channels 62, 63, 64 and 65. Two elastic straps, not shown in this figure, are connected to the four buckle strap slots 52, 53, 54 and 55. The elastic straps are connected to the buckle strap slots 52, 53, 54 and 55 by forming terminal loops, by sewing or riveting, passing an edge of the terminal loops through the buckle strap slot channels 62, 63, 64 and 65, heating and deforming the buckle slots 52, 53, 54 and 55 so as to close and weld the buckle slot channels 62, 63, 64 and 65. Buckle plate 50 can be made of a material that can be heated, deformed, closed and welded, for example a polymeric material or metal. The buckle plate can also be made to function in conjunction with the strap without the need for welding by closing the slot channels with glue, or filler material or by other suitable methods. The planar buckle plate can also be used in conjunction with the strap by simply leaving the slot channels open. The planar buckle plate can also be used without the slot channels by forming a first terminal loop in one of the straps after one of the strap ends is passed through one of the slots and then forming a second terminal loop in the same strap after the second strap end of that same strap is passed through another slot.

Figure 6A:
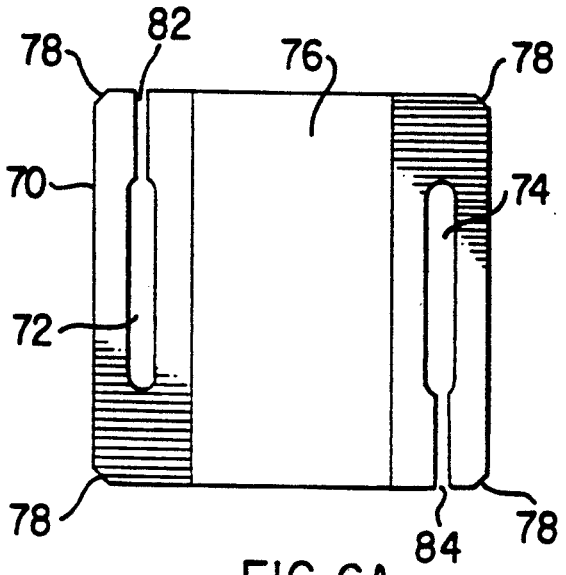
FIG. 6A shows a plan view of yet another embodiment of a buckle plate according to the invention.

FIG. 6A shows a planar buckle plate 70 according to the invention. The planar buckle plate 70 has two buckle strap slots 72 and 74. The buckle strap slots 72 and 74 are positioned so as to be substantially parallel to one another. The planar buckle plate 70 has angular corners 78. The buckle strap slots 72 and 74 are open to and accessible from an edge of the buckle through buckle strap slot channels 82 and 84. Two elastic straps, not shown in this figure, are connected to the buckle. The planar buckle plate 70 has a strap clearance groove 76. An elastic strap, of the type shown in FIGS. 1 and 2, is connected to the buckle strap slots 72 and 74 by forming terminal loops, by sewing or riveting, passing an edge of the terminal loops through the buckle strap slot channels 82 and 84, heating and deforming the buckle slots 72 and 74 so as to close the buckle slot channels 82 and 84. Buckle plate 70 can be made of a material that can be heated, deformed, closed and welded, for example a polymeric material or metal. The buckle plate can also be made to function in conjunction with the strap without the need for welding by closing the slot channels with glue, or a filler material or by other suitable methods. The planar buckle plate can also be used in conjunction with the strap by simply leaving the strap slot channels open. The planar buckle plate can also be used without the slot channels by forming a first terminal loop in one of the straps after one of the strap ends is passed through one of the slots and then forming a second terminal loop in the same strap after the second strap end of that same strap is passed through another slot. Alternatively, a bent rod could be used to engage the loops in the manner discussed previously.

Figure 6B:
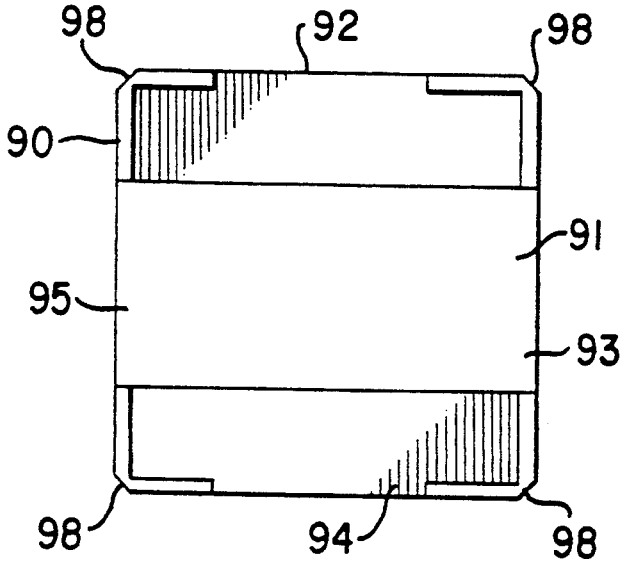
FIG. 6B shows a plan view of a buckle plate cover according to the invention, for use with the buckle plate shown in FIG. 6A.

FIG. 6B shows a buckle plate cover 90 according to the invention. The buckle plate cover 90 has a strap clearance groove 91. The buckle plate cover 90 has four buckle strap recesses 92, 93, 94 and 95. The buckle strap recesses 92 and 94 are positioned so as to be substantially parallel to one another. The buckle strap recesses 93 and 95 are positioned so as to be substantially parallel to one another. The buckle strap recesses 92 and 93 are positioned so as to be substantially perpendicular to one another. The buckle strap recesses 94 and 95 are positioned so as to be substantially perpendicular to one another. The buckle plate cover 90 has four raised alignment edges 98. Buckle plate cover 90 is configured so as to fit over and be affixed to buckle plate 80. The buckle strap recesses 92, 93, 94 and 95 function in conjunction with the strap clearance grooves 76 and 91 to allow the straps a degree of movement even when the buckle plate cover 90 is affixed to buckle plate 70. Buckle plate cover 90 can be made of a material that can be heated, deformed, closed and welded, for example a polymeric material or metal. The buckle plate cover 90 can also be made to function in conjunction with the buckle plate 70 without the need for welding by affixing the buckle plate cover 90 to the buckle plate 70 with glue or by other suitable methods.

EXAMPLES

Five specific embodiments of the invention will now be further described by the following, non-limiting examples. All of the articles discussed secure a bundle of papers, books or other objects to the face of a binder cover.

Article based upon a single elastic strap and a bent metal wire: In the first example to be discussed, a single elastic woven cloth strap is attached to a buckle and to a hinged ring notebook binder having a single binder strap slot equipped with a metal grommet. The elastic strap is approximately 1.25" in width and 45" in length. The buckle includes a polymeric buckle plate having three buckle strap slots, a bent wire rod and a buckle cover. The strap with two presewn, preriveted or otherwise prejoined terminal loops is attached to the buckle by means of the buckle plate and bent wire. The strap passes once through the binder strap slot and twice through each of the buckle strap slots. This embodiment is adjustable by manually sliding the buckle, which changes the position of the buckle relative to the face of the binder. Although the usual location of the buckle is in the center of the binder cover, by displacing the buckle across the face of the binder cover, i.e. toward one corner of the cover, books or other objects can more easily be inserted underneath the elastic strap loops. Once the books or other objects to be secured have been inserted under the elastic loops, the buckle can be displaced back toward the center of the face of the binder cover. This embodiment does not preclude the presence of additional elastic straps or nonelastic straps.

Article based upon two elastic straps and a bent metal wire: In the second example to be discussed, two elastic woven cloth straps are attached to a buckle and to a hinged ring notebook binder having a single binder strap slot equipped with a metal grommet. The elastic straps are approximately 1.25" in width and 20–25" in length. The buckle includes a polymeric buckle plate having four buckle strap slots, a bent wire rod and a buckle cover. Each of the straps with two presewn or preriveted terminal loops is attached to the buckle by means of the buckle plate and bent wire. One of the straps passes once through the binder strap slot and twice through two of the buckle strap slots. The other strap passes twice through the other two of the buckle strap slots. This embodiment is adjustable by manually sliding the buckle, which changes the position of the buckle relative to the face of the binder. Although the usual location of the buckle is in the center of the binder cover, by displacing the buckle across the face of the binder cover, i.e. toward one corner of the cover, books or other objects can more easily be inserted underneath the elastic strap loops. Once the books or other objects to be secured have been inserted under the elastic loops, the buckle can be displaced back toward the center of the face of the binder cover. This embodiment does not preclude the presence of additional elastic straps or nonelastic straps.

Article based upon a single elastic strap and deformed, welded buckle plate: In the third example to be discussed, a single elastic woven cloth strap is attached to a buckle and to a hinged ring notebook binder having a single binder strap slot equipped with a metal grommet. The elastic strap is approximately 1.25" in width and 45" in length. The buckle includes a polymeric buckle plate having three buckle strap slots and two buckle slot channels. The strap with two presewn or preriveted terminal loops is connected to two of the buckle strap slots by passing the an edge of the loops through the buckle strap slot channels of the buckle plate. The two channels are closed by heating and deforming the channels so as to close and weld the channels. The strap passes once through the binder strap slot and once through each of the buckle strap slots. This embodiment is adjustable by manually sliding the buckle, which changes the position of the buckle relative to the face of the binder. Although the usual location of the buckle is in the center of the binder cover, by displacing the buckle across the face of the binder cover, i.e. toward one corner of the cover, books or other objects can more easily be inserted underneath the elastic strap loops. Once the books or other objects to be secured have been inserted under the elastic loops, the buckle can be displaced back toward the center of the face of the binder cover. This embodiment does not preclude the presence of additional elastic straps or nonelastic straps.

Article based upon two elastic straps and a deformed welded buckle plate: In the fourth example to be discussed, two elastic woven cloth straps are attached a buckle and to a hinged ring notebook binder having a single binder strap slot equipped with a metal grommet. The elastic straps are approximately 1.25" in width and 20–25" in length. The buckle includes a polymeric buckle plate having four buckle strap slots and four buckle slot channels. Each of the straps with two presewn or preriveted terminal loops is connected to two of the buckle strap slots by passing the an edge of the loops through the buckle strap slot channels of the buckle plate. The four channels are closed by heating and deforming the channels so as to close and weld the channels. One of the straps passes once through the binder strap slot and once through two of the buckle strap slots. The other strap passes once through the other two of the buckle strap slots. This embodiment is adjustable by manually sliding the buckle, which changes the position of the buckle relative to the face of the binder. Although the usual location of the buckle is in the center of the binder cover, by displacing the buckle across the face of the binder cover, i.e. toward one corner of the cover, books or other objects can more easily be inserted underneath the elastic strap loops. Once the books or other objects to be secured have been inserted under the elastic loops, the buckle can be displaced back toward the center of the face of the binder cover. This embodiment does not preclude the presence of additional elastic straps or nonelastic straps.

Article based upon two elastic straps and a deformed welded buckle plate: In the fifth example to be discussed, two elastic woven cloth straps are attached to a buckle and to a hinged ring notebook binder having a single binder strap slot equipped with a metal grommet. The elastic straps are approximately 1.25" in width and 20–25" in length. The buckle includes a polymeric buckle plate having two buckle strap slots, two buckle slot channels and a strap clearance groove. The buckle also includes a buckle cover having a strap clearance groove. One of the straps has two presewn or preriveted terminal loops and is connected to the buckle strap slots by passing the an edge of the loops through the buckle strap slot channels of the buckle plate. The two channels are closed by heating and deforming the channels so as to close and weld the channels. The first strap passes once through the binder strap slot and once through each of the buckle strap slots so as to define a loop. The other strap is in the form of a continuous loop and is wrapped around the binder cover that is equipped with the binder strap slot so as to be approximately perpendicular to the loop that will be defined by the first strap and the buckle. The buckle cover is then affixed to the buckle plate so that the strap clearance groove of the buckle cover is approximately perpendicular to the strap clearance groove of the buckle plate. This embodiment is adjustable by manually sliding the buckle, which changes the position of the buckle relative to the face of the binder. Although the usual location of the buckle is in the center of the binder cover, by displacing the buckle across the face of the binder cover, i.e. toward one corner of the cover, books or other objects can more easily be inserted underneath the elastic strap loops. Once the books or other objects to be secured have been inserted under the elastic loops, the buckle can be displaced back toward the center of the face of the binder cover. This embodiment does not preclude the presence of additional elastic straps or nonelastic straps.

While there is shown and described herein certain specific structures embodying this invention for the purpose of clarity of understanding, the same is to be considered as illustrative in character, it being understood that only preferred embodiments have been shown and described. It will be manifest to those skilled in the art that certain changes, various modifications and rearrangements of the parts may be made without departing from the spirit and scope of the underlying inventive concept and that the same is not limited to the particular forms herein shown and described except insofar as indicated in the scope of the appended claims.

What is claimed is:

1. An article comprising:

a first elastic strap comprising a first end and a second end;

a second elastic strap comprising a continuous loop;

a notebook binder attached to said first elastic strap comprising a first cover, a center spine and a second cover comprising at least one binder strap slot; and a buckle attached to said first elastic strap and said second elastic strap comprising at least two buckle strap slots, wherein a first of said at least two buckle strap slots and a second of said at least two buckle strap slots are positioned so as to be substantially parallel to one another, wherein said notebook binder is attached to said first elastic strap by passing said first elastic strap through said at least one binder strap slot at least once, wherein said continuous loop of said second elastic strap encircles said second cover, wherein said first elastic strap is connected to said first of said at least two buckle strap slots, wherein said first elastic strap is connected to said second of said at least two buckle strap slots, and wherein said notebook binder and said buckle hold said first elastic strap and said second elastic strap in a configuration that defines two approximately perpendicular loops.

2. The article of claim 1, wherein the notebook binder is a hinged ring notebook binder.

3. The article of claim 1, wherein the notebook binder further comprises a metal grommet positioned around an edge of said at least one binder strap slot.

4. The article of claim 1, wherein the buckle comprises a buckle plate in which the buckle strap slots are formed.

5. The article of claim 4, wherein said buckle further comprises a buckle cover, and wherein said first of said at least two buckle strap slots is open to and accessible from an edge of the buckle through a first buckle strap slot channel, wherein said first elastic strap is connected to said first of said at least two buckle strap slots by forming a first terminal loop in said first elastic strap, passing an edge of said first terminal loop through said first buckle strap slot channel and connecting said first terminal loop to said first of said at least two buckle strap slots by closing said first buckle slot channel, wherein said second of said two buckle strap slots is open to and accessible from an edge of the buckle through a second buckle strap slot channel, wherein said first elastic strap is connected to said second of the two buckle strap slots by forming a second terminal loop in said first elastic strap, passing an edge of said second terminal loop through said second buckle strap slot channel and connecting said second terminal loop to said second of said two buckle strap slots by closing said second buckle slot channel.

6. The article of claim 4, wherein said buckle further comprises a bent metal rod and a buckle cover, and wherein said first elastic strap is connected to said first of the at least two buckle strap slots by forming a first terminal loop in said first elastic strap, passing said first terminal loop through said first of the at least two buckle strap slots and connecting said first terminal loop to said first of the at least two buckle strap slots by passing said bent metal rod, which is longer than said first of the at least two buckle strap slots, through said first terminal loop, wherein said elastic strap is connected to said second of said at least two buckle strap slots by forming a second terminal loop in said first elastic strap, passing said second terminal loop through said second of said at least two buckle strap slots and connecting said second terminal loop to said second of said at least two buckle strap slots by passing said bent metal rod, which is longer than said second of said at least two buckle strap slots, through said second terminal loop, and wherein said buckle cover prevents the removal of said bent metal wire from said terminal loops.

7. The article of claim 4, wherein said buckle further comprises a buckle cover comprising four buckle strap recesses and a strap clearance groove, wherein said buckle plate further comprises a strap clearance groove, and wherein said buckle cover is joined to said buckle plate with said strap clearance groove of said buckle cover substantially perpendicular to said strap clearance groove of said buckle plate so as to allow said first elastic strap and said second elastic strap to pass freely through said four buckle strap recesses.

8. The article of claim 1, wherein said buckle further comprises a buckle cover, and wherein said first of said at least two buckle strap slots is open to and accessible from an edge of the buckle through a first buckle strap slot channel, wherein said first elastic strap is connected to said first of said at least two buckle strap slots by joining said first end of said first elastic strap to said first elastic strap to form a first terminal loop in said first elastic strap, passing an edge of said first terminal loop through said first buckle strap slot channel and connecting said first terminal loop to said first of said at least two buckle strap slots by closing said first buckle slot channel, wherein said second of said two buckle strap slots is open to and accessible from an edge of the buckle through a second buckle strap slot channel, wherein said first elastic strap is connected to said second of the two buckle strap slots by joining said second end of said first elastic strap to said first elastic strap to form a second terminal loop in said first elastic strap, passing an edge of said second terminal loop through said second buckle strap slot channel and connecting said second terminal loop to said second of said two buckle strap slots by closing said second buckle slot channel.

9. The article of claim 8, wherein said first buckle strap slot channel is closed and welded by heating and deforming said first buckle strap slot channel, and wherein said second buckle strap slot channel is closed and welded by heating and deforming said second buckle strap slot channel.

10. An article comprising:

an elastic strap comprising a first end and a second end;

a notebook binder attached to said elastic strap comprising a first cover, a center spine and a second cover comprising at least one binder strap slot; and a buckle attached to said elastic strap comprising at least two buckle strap slots, wherein said notebook binder is attached to said elastic strap by passing said elastic strap through said at least one binder strap slot at least once, wherein said first end and said second end of said elastic strap are connected to said at least two buckle strap slots, and wherein said notebook binder and said buckle hold said elastic strap in a configuration that defines two approximately perpendicular loops, wherein said buckle further comprises a bent metal rod and a buckle cover, and wherein said elastic strap is connected to a first of the two buckle strap slots by forming a first terminal loop in said elastic strap, passing said first terminal loop through said first of the two buckle strap slots and connecting said first terminal loop to said first of the two buckle strap slots by passing said bent metal rod, which is longer than said first of the two buckle strap slots, through said first terminal loop, wherein said elastic strap is connected to a second of the two buckle strap slots by forming a second terminal loop in said elastic strap, passing said second terminal loop through said second of the two buckle strap slots and connecting said first terminal loop to said second of the two buckle strap slots by passing said bent metal rod, which is longer than said second of the two buckle strap slots, through said second terminal loop, and wherein said buckle cover is joined to said buckle so as to prevent the removal of said bent metal wire from said first terminal loop and said second terminal loop.

11. The article of claim 10, wherein the notebook binder further comprises a metal grommet positioned around an edge of said at least one binder strap slot.

12. The article of claim 10, wherein the buckle comprises a buckle plate in which the buckle strap slots are formed.

13. The article of claim 10, wherein said buckle further comprises a buckle cover comprising four buckle strap recesses and a strap clearance groove, wherein said buckle plate further comprises a strap clearance groove, and wherein said buckle cover is joined to said buckle plate with said strap clearance groove of said buckle cover substantially perpendicular to said strap clearance groove of said buckle plate so as to allow said elastic strap to pass freely through said four buckle strap recesses.

14. An article comprising:

an elastic strap comprising a first end and a second end;

a notebook binder attached to said elastic strap comprising a first cover, a center spine and a second cover comprising at least one binder strap slot; and a buckle attached to said elastic strap comprising at least two buckle strap slots, wherein said notebook binder is attached to said elastic strap by passing said elastic strap through said at least one binder strap slot at least once, wherein said first end and said second end of said elastic strap are connected to said at least two buckle strap slots, and wherein said notebook binder and said buckle hold said elastic strap in a configuration that defines two approximately perpendicular loops, wherein a first of the two buckle strap slots is open to and accessible from an edge of the buckle through a first buckle strap slot channel, wherein said elastic strap is connected to said first of the two buckle strap slots by joining said first end of said elastic strap to said elastic strap to form a first terminal loop in said elastic strap, passing an edge of said first terminal loop through said first buckle strap slot channel and closing said first buckle strap slot channel, and wherein a second of the two buckle strap slots is open to and accessible from an edge of the buckle through a second buckle strap slot channel, wherein said elastic strap is connected to said second of the two buckle strap slots by joining said second end of said elastic strap to said elastic strap to form a second terminal loop in said elastic strap, passing an edge of said second terminal loop through said second buckle strap slot channel and closing said second buckle strap slot channel.

15. The article of claim 14, wherein said first buckle strap slot channel is closed and welded by heating and deforming said first buckle strap slot channel, and wherein said second buckle strap slot channel is closed and welded by heating and deforming said second buckle strap slot channel.

16. The article of claim 14, wherein the notebook binder further comprises a metal grommet positioned around an edge of said at least one binder strap slot.

17. The article of claim 14, wherein the buckle comprises a buckle plate in which the buckle strap slots are formed.

18. The article of claim 14, wherein said buckle further comprises a buckle cover comprising four buckle strap recesses and a strap clearance groove, wherein said buckle plate further comprises a strap clearance groove, and wherein said buckle cover is joined to said buckle plate with said strap clearance groove of said buckle cover substantially perpendicular to said strap clearance groove of said buckle plate so as to allow said elastic strap to pass freely through said four buckle strap recesses.

* * * * *